US010369780B2

(12) United States Patent
Suzuki

(10) Patent No.: US 10,369,780 B2
(45) Date of Patent: Aug. 6, 2019

(54) PRINTING APPARATUS

(71) Applicant: CANON KABUSHIKI KAISHA, Tokyo (JP)

(72) Inventor: Seiji Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/937,949

(22) Filed: Mar. 28, 2018

(65) Prior Publication Data

US 2018/0290444 A1 Oct. 11, 2018

(30) Foreign Application Priority Data

Apr. 11, 2017 (JP) ..... 2017-078481

(51) Int. Cl.

| | |
|---|---|
| ***B41J 2/165*** | (2006.01) |
| ***B41J 25/00*** | (2006.01) |
| ***B41J 2/005*** | (2006.01) |
| ***B41J 25/304*** | (2006.01) |
| *B41J 2/01* | (2006.01) |

(52) U.S. Cl.

CPC ..... *B41J 2/0057* (2013.01); *B41J 2/165* (2013.01); *B41J 2/16517* (2013.01); *B41J 2/16588* (2013.01); *B41J 25/001* (2013.01); *B41J 25/304* (2013.01); *B41J 2002/012* (2013.01); *B41J 2025/008* (2013.01)

(58) Field of Classification Search

CPC ..... B41J 2/0057; B41J 25/304; B41J 2/165; B41J 25/001; B41J 2002/012; B41J 2/16517; B41J 2/16588; B41J 2025/008

See application file for complete search history.

(56) References Cited

U.S. PATENT DOCUMENTS

| | | | | |
|---|---|---|---|---|
| 6,682,189 | B2 | 1/2004 | May et al. | |
| 6,767,092 | B2 | 7/2004 | May et al. | |
| 8,061,805 | B2 | 11/2011 | Suzuki et al. | |
| 8,757,766 | B2 | 6/2014 | Suzuki et al. | |
| 9,079,408 | B2 | 7/2015 | Suzuki et al. | |
| 9,085,163 | B2 | 7/2015 | Sunouchi et al. | |
| 9,096,065 | B2 | 8/2015 | Nakano et al. | |
| 9,193,169 | B2 | 11/2015 | Sunouchi et al. | |
| 2003/0067529 | A1 | 4/2003 | May et al. | |
| 2003/0095170 | A1* | 5/2003 | Johnson | B41J 2/0057 347/104 |
| 2004/0070656 | A1 | 4/2004 | May et al. | |
| 2009/0284566 | A1* | 11/2009 | Suzuki | B41J 2/16588 347/38 |

FOREIGN PATENT DOCUMENTS

| | | | |
|---|---|---|---|
| JP | 2003182064 | A | 7/2003 |
| JP | 2012161961 | A | 8/2012 |

* cited by examiner

*Primary Examiner* — Yaovi M Ameh
(74) *Attorney, Agent, or Firm* — Venable LLP

(57) ABSTRACT

A printing apparatus includes a printing unit configured to form an ink image on a transfer member by discharging ink, a transfer unit configured to transfer the ink image formed on the transfer member to a print medium, a recovery unit configured to recover performance of the printing unit, a guide unit configured to guide the printing unit to a recovery position for the recovery unit to recover the performance of the printing unit and a discharge position for the printing unit to discharge the ink to the transfer member, and a positioning structure configured to position the printing unit at the discharge position.

7 Claims, 20 Drawing Sheets

PRINTING APPARATUS

BACKGROUND OF THE INVENTION

Field of the Invention

The present invention relates to a transfer type printing technique.

Description of the Related Art

A technique of forming an ink image on a transfer member and transferring it to a print medium such as paper is proposed. For example, Japanese Patent Laid-Open No. 2003-182064 discloses an image forming apparatus configured to form an ink image on an intermediate member and transfer the ink image to a sheet. This apparatus includes an inkjet device that forms a primary image on the intermediate member. This apparatus also includes a zone where an aggregate is formed in the primary image, a zone where a liquid is partially removed from the aggregate, a zone where an image is transferred to a sheet, and a zone where the surface of the intermediate member is reproduced before a new primary image is formed. Moreover, Japanese Patent Laid-Open No. 2012-161961 discloses an inkjet printer that includes a mechanism capable of adjusting the position of a head unit which discharges ink to a drum which conveys a print medium.

Performance of a printhead which discharges ink may be degraded as it is used. As a measure against this, adoption of an arrangement for providing a recovery apparatus which recovers the performance of the printhead, and moving the printhead between a discharge position where the ink is discharged to a transfer member and a recovery position where the recovery apparatus recovers the performance is considered. However, an ink discharge position with respect to the transfer member may shift if there is a positional shift when the printhead returns from the recovery position to the discharge position.

SUMMARY OF THE INVENTION

The present invention provides a technique of improving position accuracy when a printhead returns from a recovery position to a discharge position.

According to an aspect of the present invention, there is provided a printing apparatus comprising: a printing unit configured to form an ink image on a transfer member by discharging ink; a transfer unit configured to transfer the ink image formed on the transfer member to a print medium; a recovery unit configured to recover performance of the printing unit; a guide unit configured to guide the printing unit to a recovery position for the recovery unit to recover the performance of the printing unit and a discharge position for the printing unit to discharge the ink to the transfer member; and a positioning structure configured to position the printing unit at the discharge position.

Further features of the present invention will become apparent from the following description of exemplary embodiments (with reference to the attached drawings).

DESCRIPTION OF THE EMBODIMENTS

Embodiments of the present invention will be described with reference to the accompanying drawings. In each view, arrows X and Y indicate horizontal directions perpendicular to each other. An arrow Z indicates a vertical direction.

<Printing System>

Figure 1:
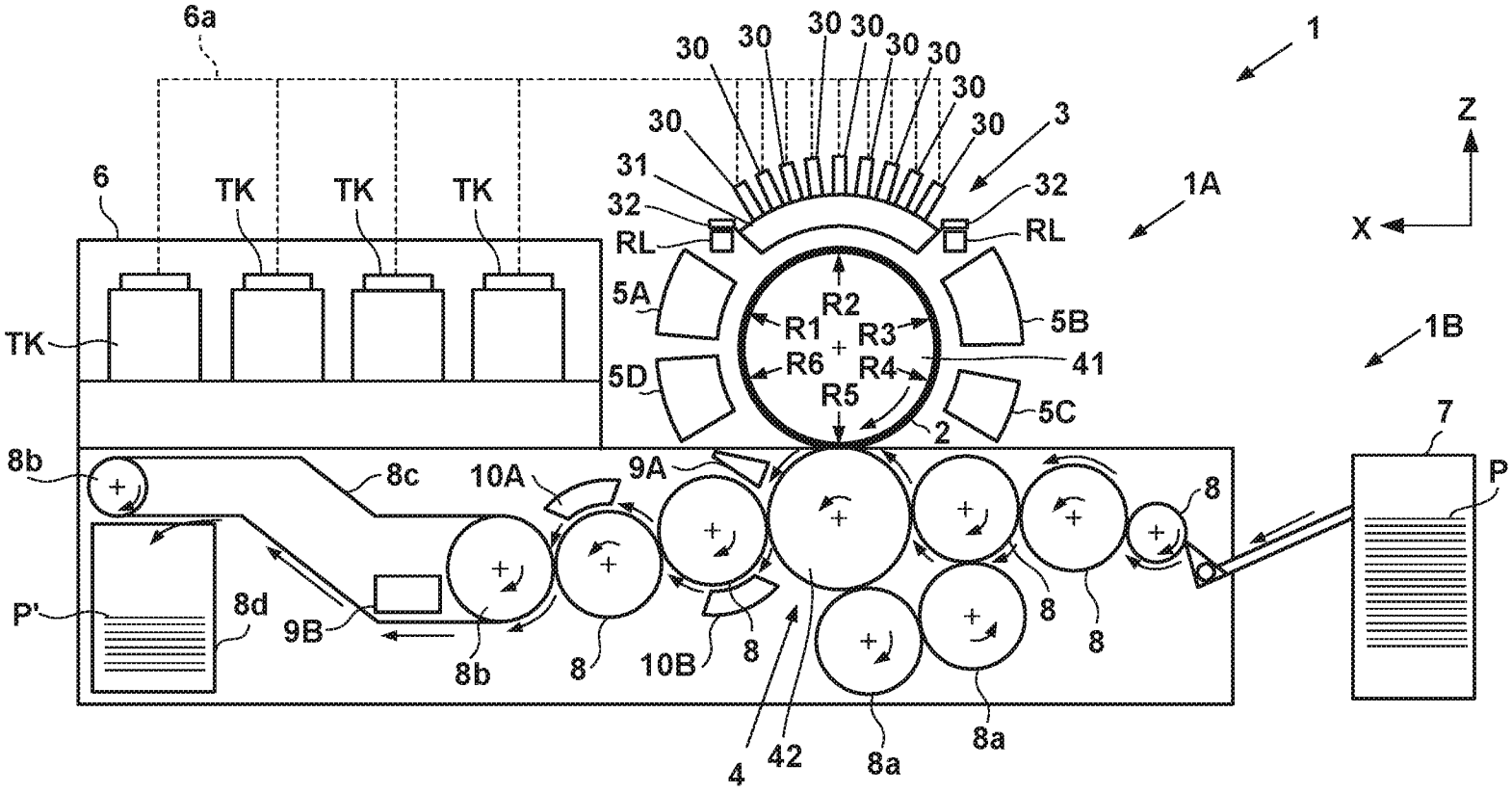
FIG. 1 is a schematic view showing a printing system.

FIG. 1 is a front view schematically showing a printing system (printing apparatus) 1 according to an embodiment of the present invention. The printing system 1 is a sheet inkjet printer that forms (manufactures) a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like.

An ink component is not particularly limited. In this embodiment, however, a case is assumed in which aqueous pigment ink that includes a pigment as a coloring material, water, and a resin is used.

<Printing Apparatus>

The printing apparatus 1A includes a printing unit 3, a transfer unit 4, peripheral units 5A to 5D, and a supply unit 6.

<Printing Unit>

Figure 2:
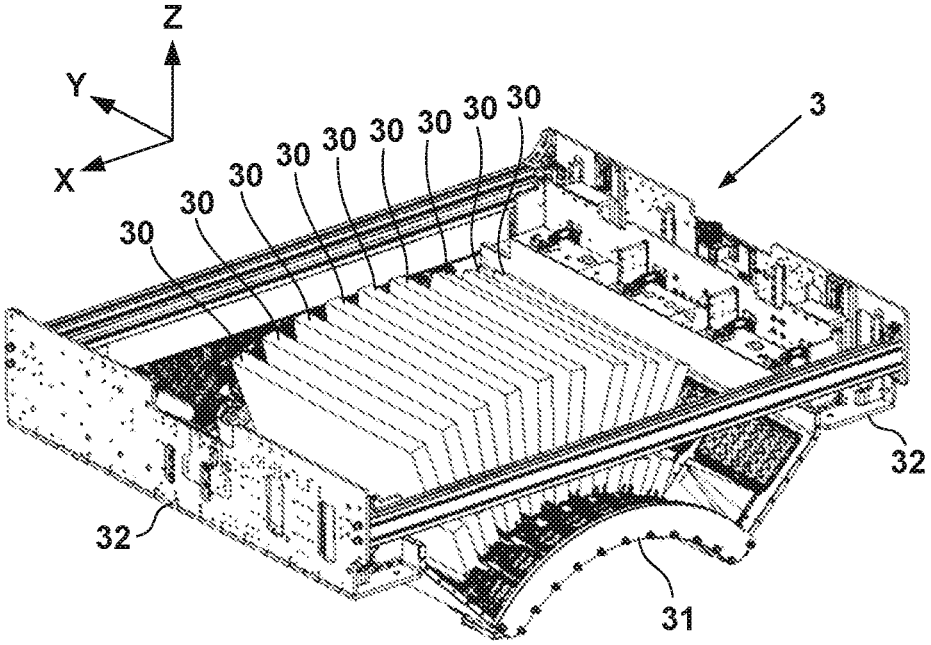
FIG. 2 is a perspective view showing a printing unit.

The printing unit 3 includes a plurality of printheads 30 and a carriage 31. A description will be made with reference to FIGS. 1 and 2. FIG. 2 is perspective view showing the printing unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide unit RL. In this embodiment, the guide units RL are rail-like structures elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
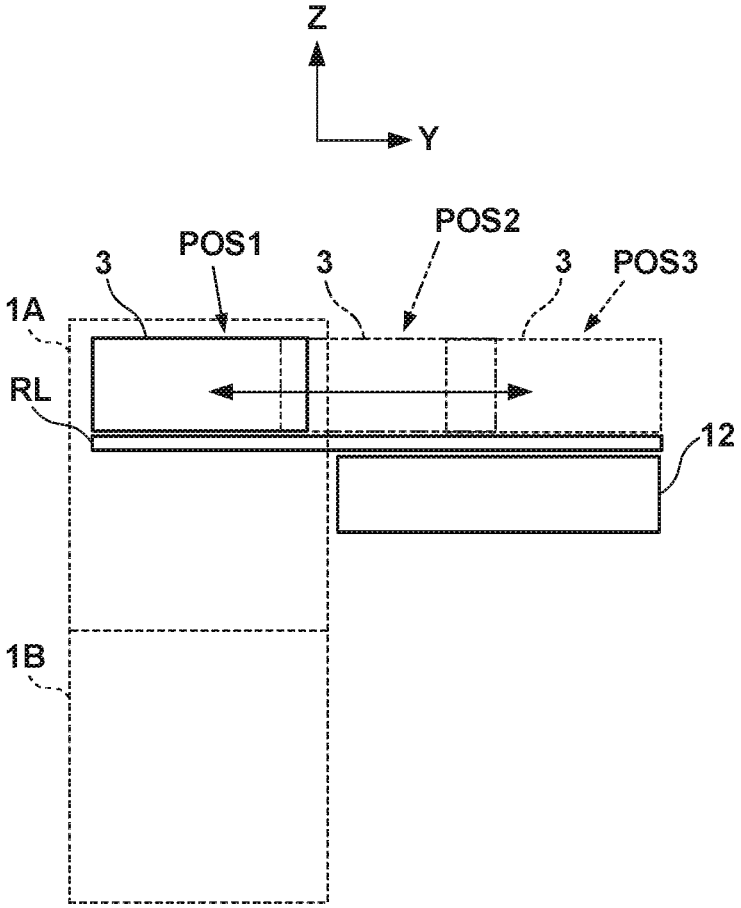
FIG. 3 is an explanatory view showing a displacement mode of the printing unit in FIG. 2.

FIG. 3 is a view showing a displacement mode of the printing unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide unit RL is elongated over the recovery unit 12 from the side of the transfer member 2. By the guide of the guide unit RL, the printing unit 3 is displaceable between a discharge position POS1 at which the printing unit 3 is indicated by a solid line and a recovery position POS3 at which the printing unit 3 is indicated by a broken line, and is moved by a driving mechanism (not shown).

The discharge position POS1 is a position at which the printing unit 3 discharges ink to the transfer member 2 and a position at which the ink discharge surface of each printhead 30 faces the surface of the transfer member 2. The recovery position POS3 is a position retracted from the discharge position POS1 and a position at which the printing unit 3 is positioned above the recovery unit 12. The recovery unit 12 can perform performance recovery processing on the printheads 30 when the printing unit 3 is positioned at the recovery position POS3. In this embodiment, the recovery unit 12 can also perform the recovery processing in the middle of movement before the printing unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum (transfer cylinder) 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the printing unit 3 discharges ink and an area where the peripheral unit 5A performs processing. In this embodiment, a reactive liquid is applied. The discharge area R2 is a formation area where the printing unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 can share a driving source such as a motor that drives them, and a driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the printing unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the printing unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the printing unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, glossy, and the like of an image on the image printed surface of the printed product P'. For example, liquid application, sheet welding, lamination, and the like can be given as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
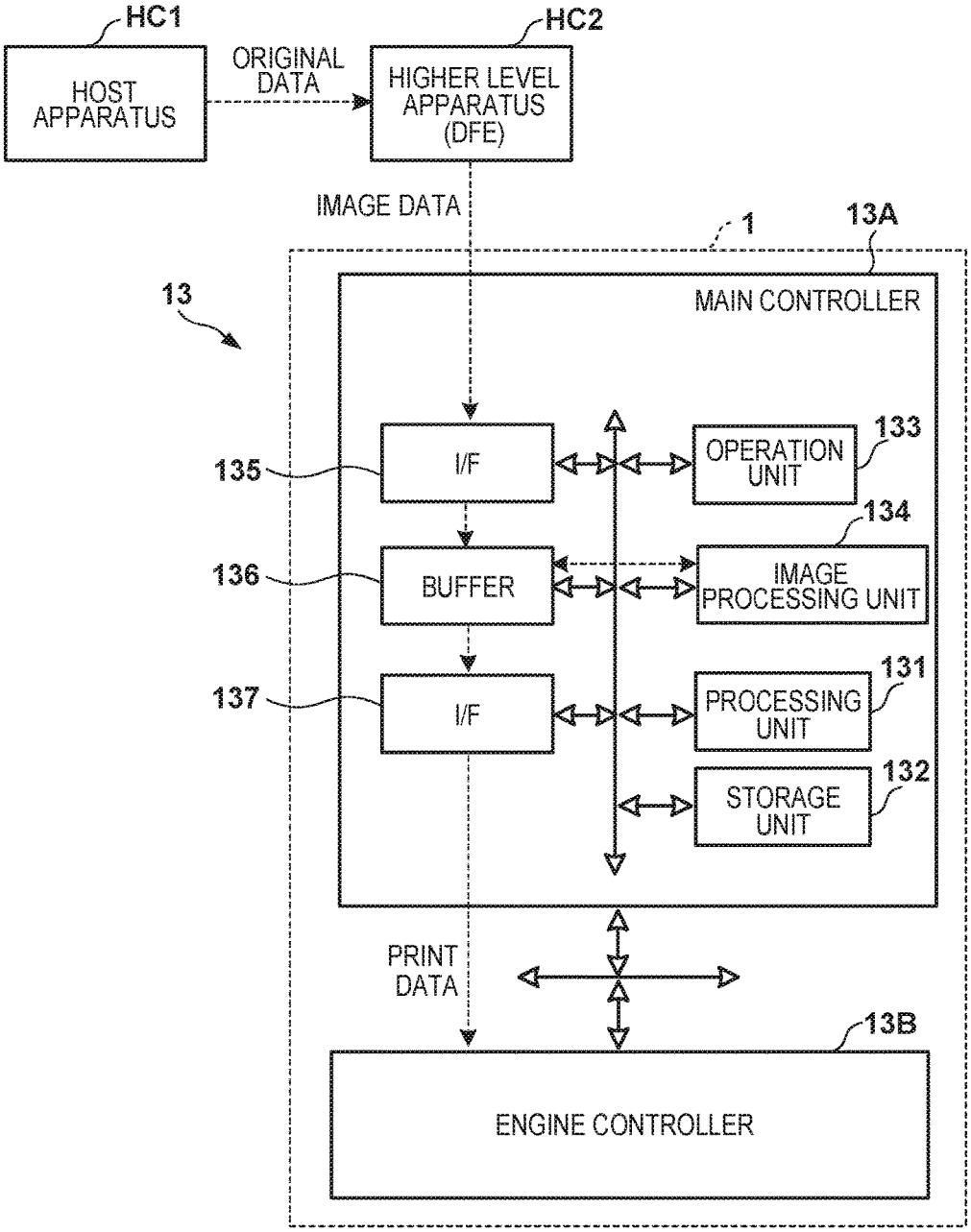
FIG. 4 is a block diagram showing a control system of the printing system in FIG. 1.
Figure 5:
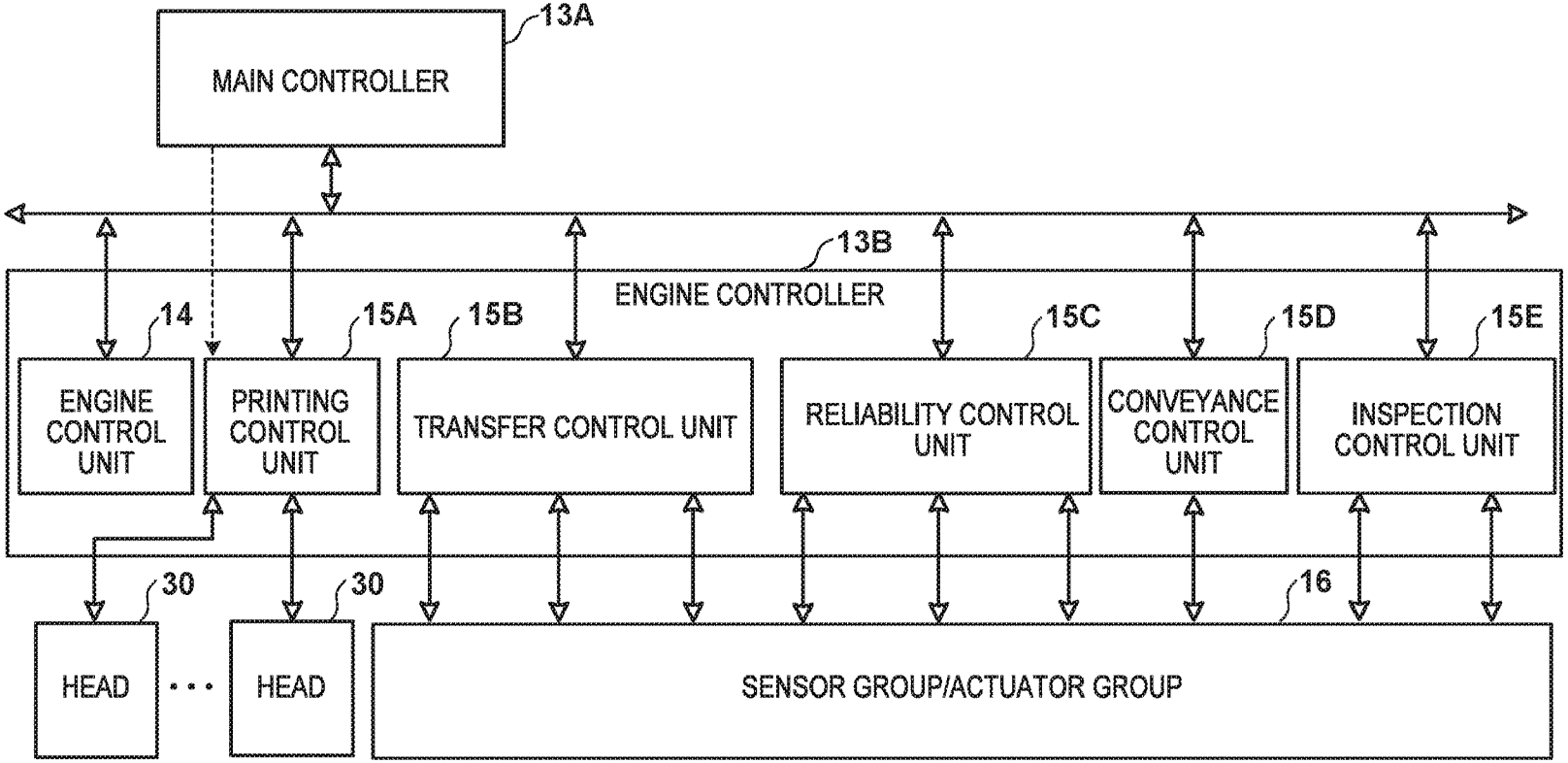
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. The operation unit 133 is, for example, an input device such as a touch panel, a keyboard, or a mouse and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the printing unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
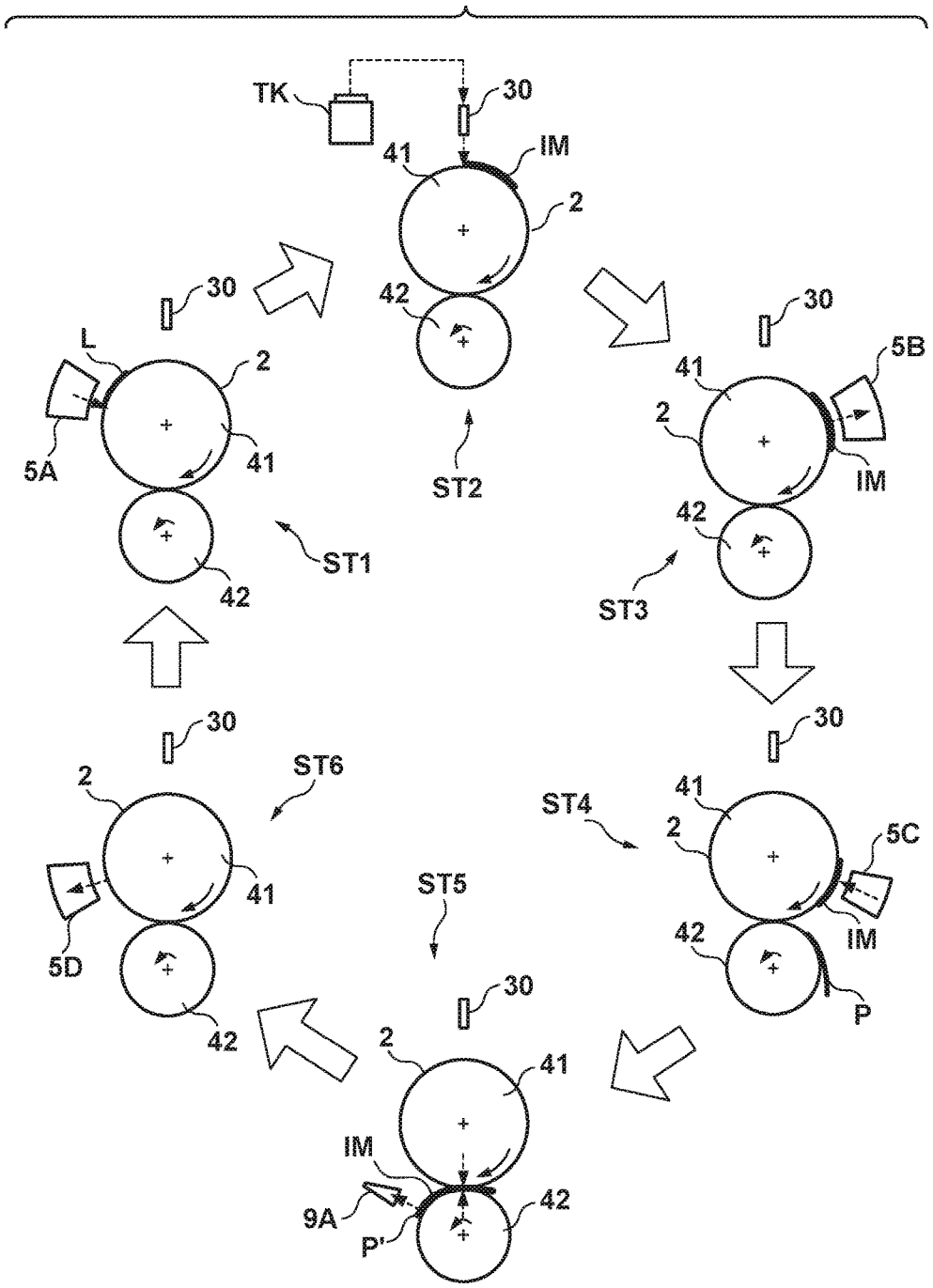
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Figure 7:
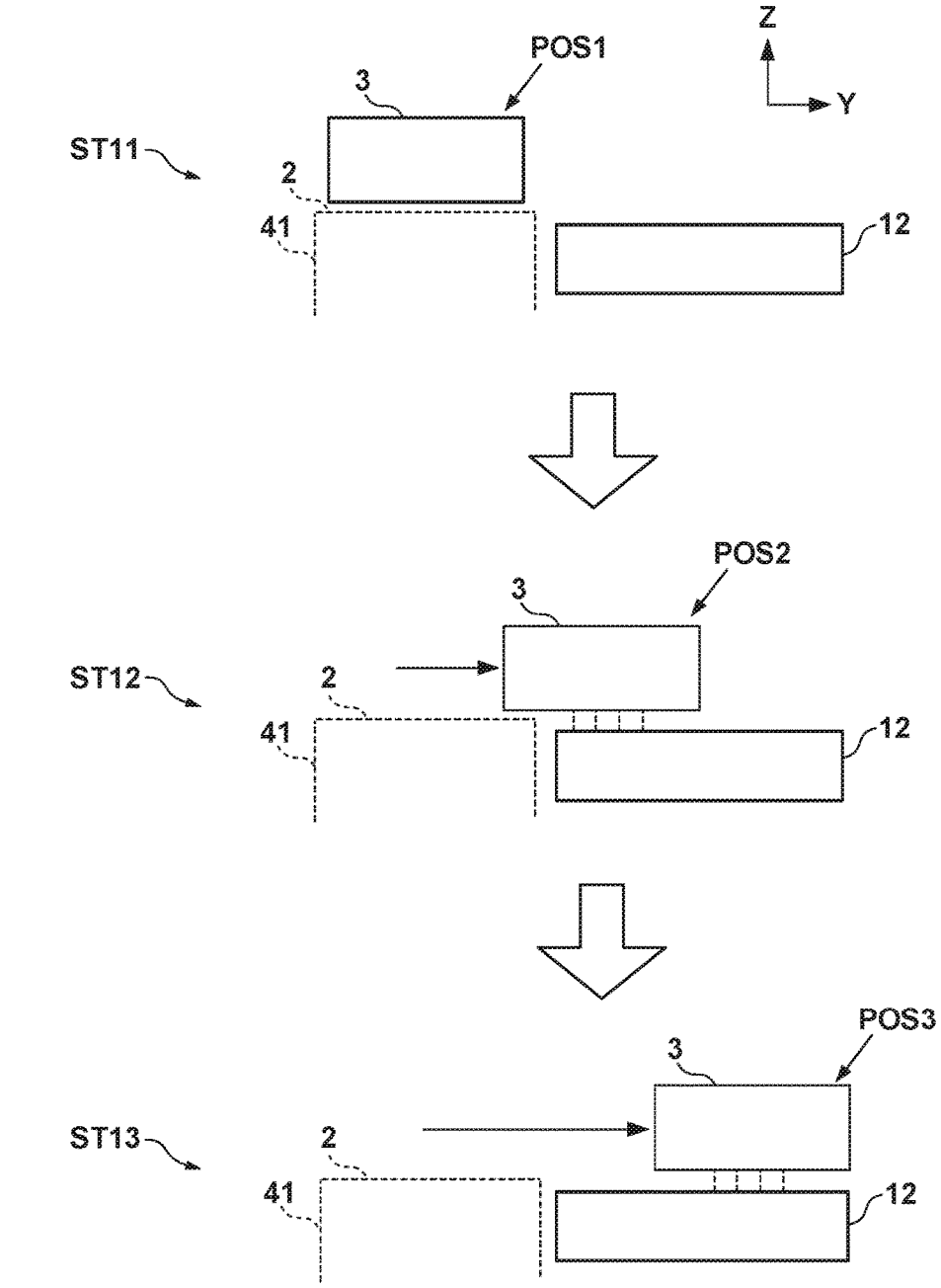
FIG. 7 is an explanatory view showing an example of the operation of the printing system in FIG. 1.

Each printhead 30 needs maintenance if such a printing operation continues. FIG. 7 shows an operation example at the time of maintenance of each printhead 30. A state ST11 shows a state in which the printing unit 3 is positioned at the discharge position POS1. A state ST12 shows a state in which the printing unit 3 passes through the preliminary recovery position POS2. Under passage, the recovery unit 12 performs a process of recovering discharge performance of each printhead 30 of the printing unit 3. Subsequently, as shown in a state ST13, the recovery unit 12 performs the process of recovering the discharge performance of each printhead 30 in a state in which the printing unit 3 is positioned at the recovery position POS3.

<Peripheral Structure of Printing Unit>

Figure 8:
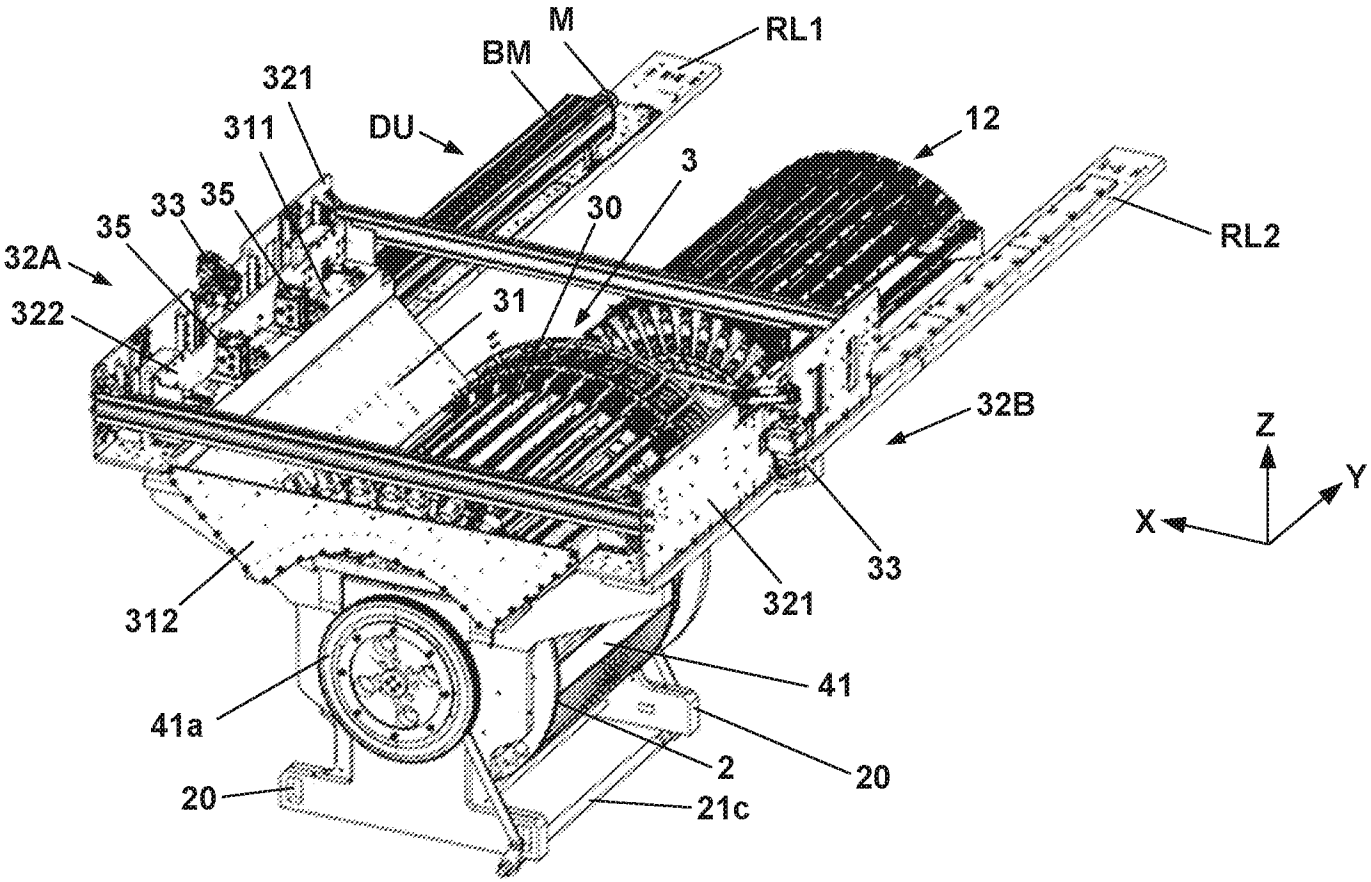
FIG. 8 is a perspective view showing the displacement mode and peripheral structure of the printing unit.
Figure 9:
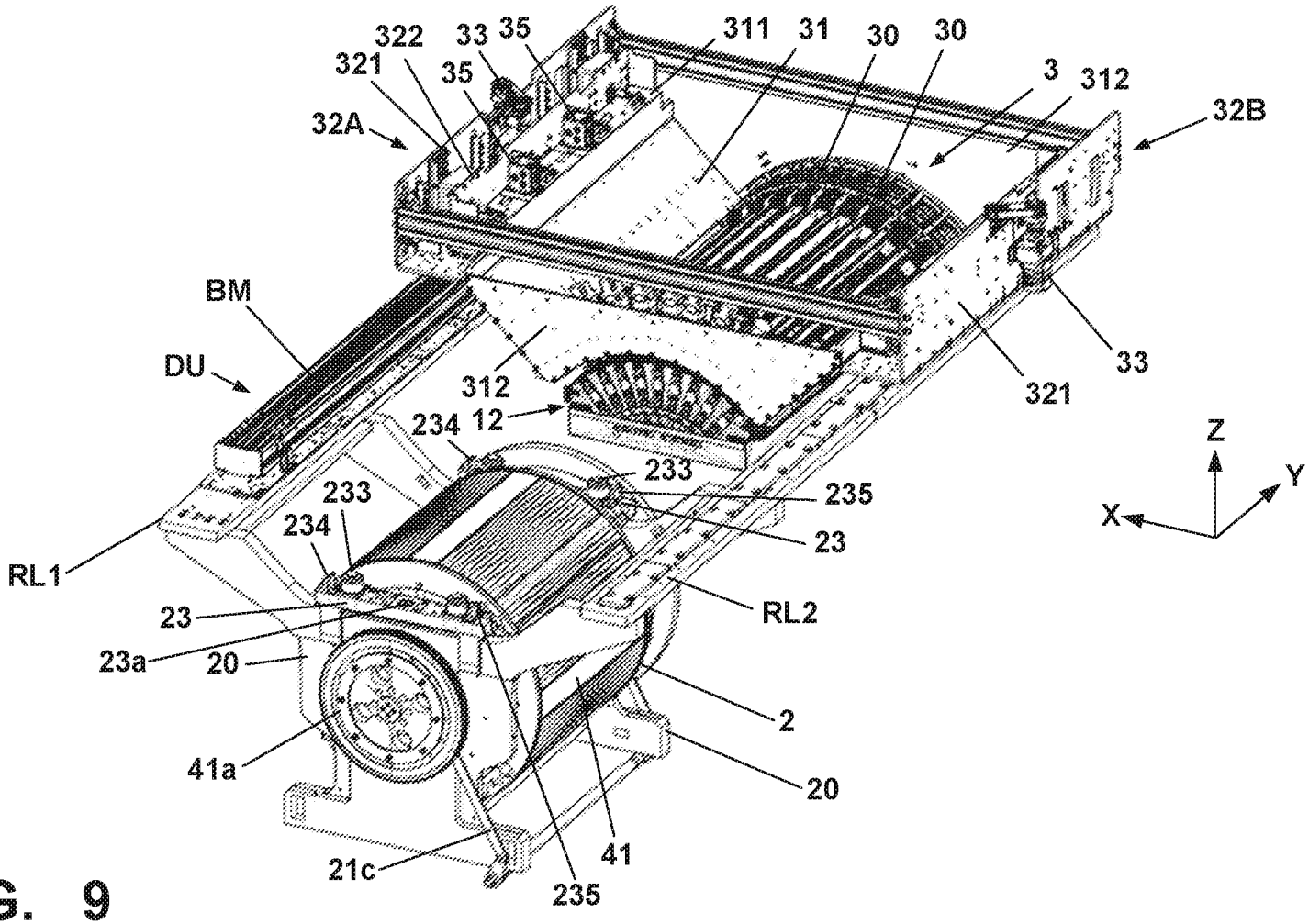
FIG. 9 is a perspective view showing the displacement mode and peripheral structure of the printing unit.

A detailed example of the peripheral structure of the printing unit 3 will be described with reference to FIGS. 8 and 9. Each of FIGS. 8 and 9 shows the layout of the printing unit 3, the transfer drum 41, and the recovery unit 12. FIG. 8 shows a state in which the printing unit 3 is located at the above-described discharge position POS1. FIG. 9 shows a state in which the printing unit 3 is located at the above-described recovery position POS3. The recovery unit 12 is arranged adjacent to the transfer drum 41 in the Y direction.

Guide units RL1 and RL2 corresponding to the above-described guide units RL both extend in parallel in the Y direction, and are spaced apart from each other in the X direction. Out of slide portions 32A and 32B each corresponding to the above-described slide portion 32, the slide portion 32A is guided by the guide unit RL1, and the slide portion 32B is guided by the guide unit RL2.

In this embodiment, the guide unit RL1 includes a driving mechanism DU. The driving mechanism DU includes a driving source M such as a motor and a transmission mechanism BM that transfers a driving force to the slide portion 32A. In an example of each of FIGS. 8 and 9, the transmission mechanism BM is a ball screw mechanism, and a ball screw extends in the Y direction. The driving source M rotates the ball screw. A ball nut (not shown) is provided on the bottom of the corresponding slide portion 32A and engages with the ball screw of the transmission mechanism BM. The slide portion 32A slides in the Y direction by rotating the ball screw.

In this embodiment, the guide unit RL2 does not include the driving mechanism DU but includes a rail member. An engaging portion (not shown) which engages with this rail member is provided on the bottom of the corresponding slide portion 32B. The slide portion 32A and the slide portion 32B are connected by a beam member, and the slide portion 32B also moves in accordance with the movement of the slide portion 32A by the driving mechanism DU. Consequently, the printing unit 3 translates in the Y direction.

Figure 10A:
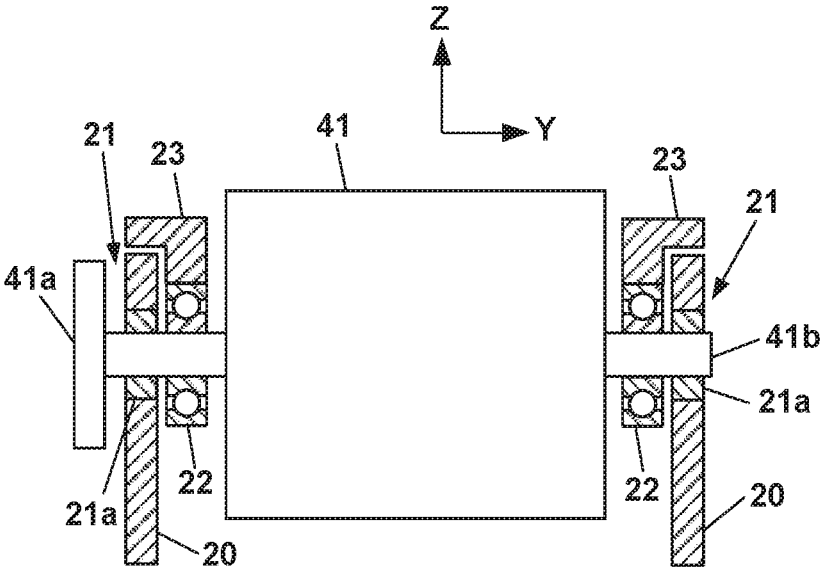
FIGS. 10A and 10B are views for explaining an axial distance adjusting unit.
Figure 10B:
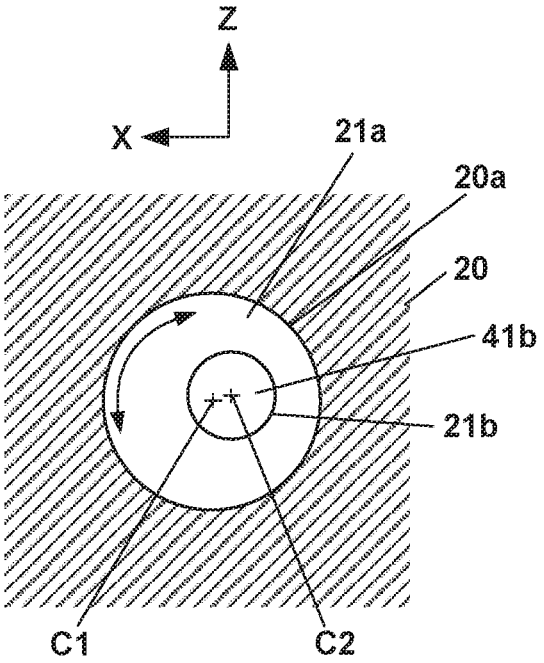

A pair of frames 20 support the ends of the guide units RL1 and RL2. The frames 20 have a solid structure that forms a part of the framework of the printing system 1. The pair of frames 20 are plate-like members each having a Y-shaped outer shape and are arranged separately from each other in the Y direction. The transfer drum 41 is supported rotatably between the pair of frames 20. In addition to FIGS. 8 and 9, FIGS. 10A and 10B are referred to. FIGS. 10A and 10B are schematic views each showing an axial support structure of the transfer drum 41.

A rotation-center axis 41*b* of the transfer drum 41 extends in the Y direction, and a gear 41*a* is fixed to its one end. A driving force from the driving source such as the motor that drives the transfer drum 41 and the pressurizing drum 42 is transmitted to the gear 41*a*, rotating the transfer drum 41. The axial support structure of the rotation-center axis 41*b* includes an axial distance adjusting mechanism 21. The axial distance adjusting mechanism 21 is a mechanism that displaces the rotation-center axis 41*b* of the transfer drum 41 with respect to the rotation-center axis (not shown) of the pressurizing drum 42. The degree of pressure contact between the pressurizing drum 42 and the transfer member 2 on the transfer drum 41 changes by adjusting a distance between these rotation-center axes. This makes it possible to adjust a pressure contact state between the surface of the transfer member and the surface of the pressurizing drum 42 in accordance with the thickness of the print medium that passes between the transfer member 2 and the pressurizing drum 42, and to implement smooth transfer according to the thickness of the print medium.

The axial distance adjusting mechanism 21 may have any arrangement and in this embodiment, it adopts an adjusting mechanism by the rotation of an eccentric bearing 21*a*. The eccentric bearing 21*a* is a disc-shaped bearing and rotatably fitted in a circular hole 20*a* of the frame 20. A bearing hole 21*b* that rotatably supports the rotation-center axis 41*b* is formed in the eccentric bearing 21*a*. The center of this bearing hole 21*b* (an axis center of the rotation-center axis 41*b*) C2 is located away from a rotation center C1 of the eccentric bearing 21*a*. Therefore, the position of the center C2 of the rotation-center axis 41*b* is displaced by rotating the eccentric bearing 21*a*. This means that the rotation-center axis 41*b* of the transfer drum 41 is displaced with respect to the rotation-center axis (not shown) of the pressurizing drum 42. This makes it possible to adjust a distance between the rotation-center axes of the transfer drum 41 and the pressurizing drum 42. A handle 21*c* shown in FIGS. 8 and 9 is connected to the eccentric bearing 21*a*, and the user can rotate the eccentric bearing 21*a* and adjust a center distance by operating the handle 21*c*. The position of the handle 21*c* is locked by a lock mechanism (not shown).

Figure 11A:
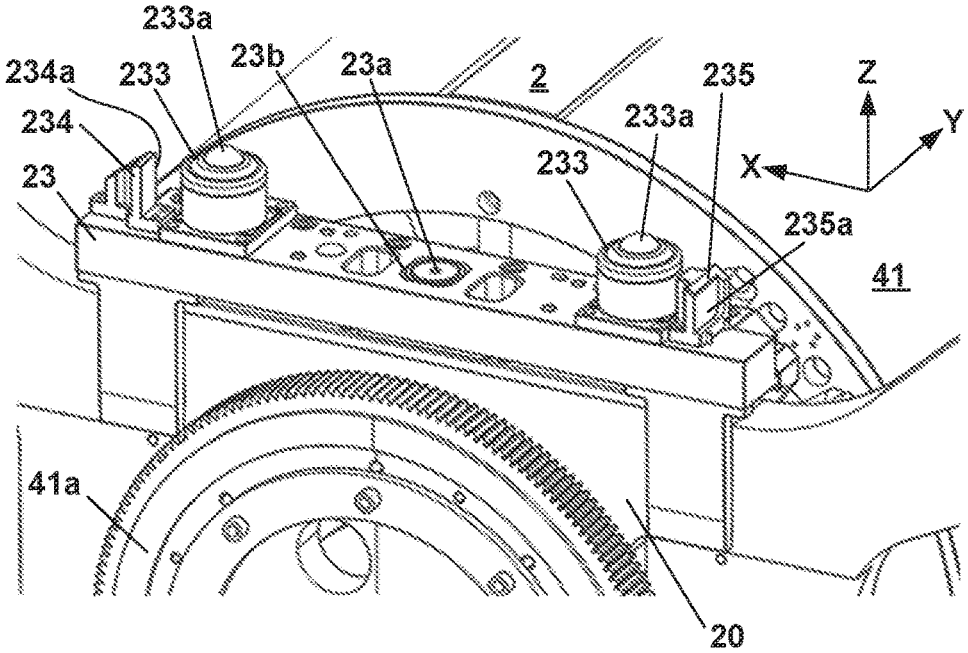
FIGS. 11A and 11B are views for explaining a supporting unit that supports the printing unit.
Figure 11B:
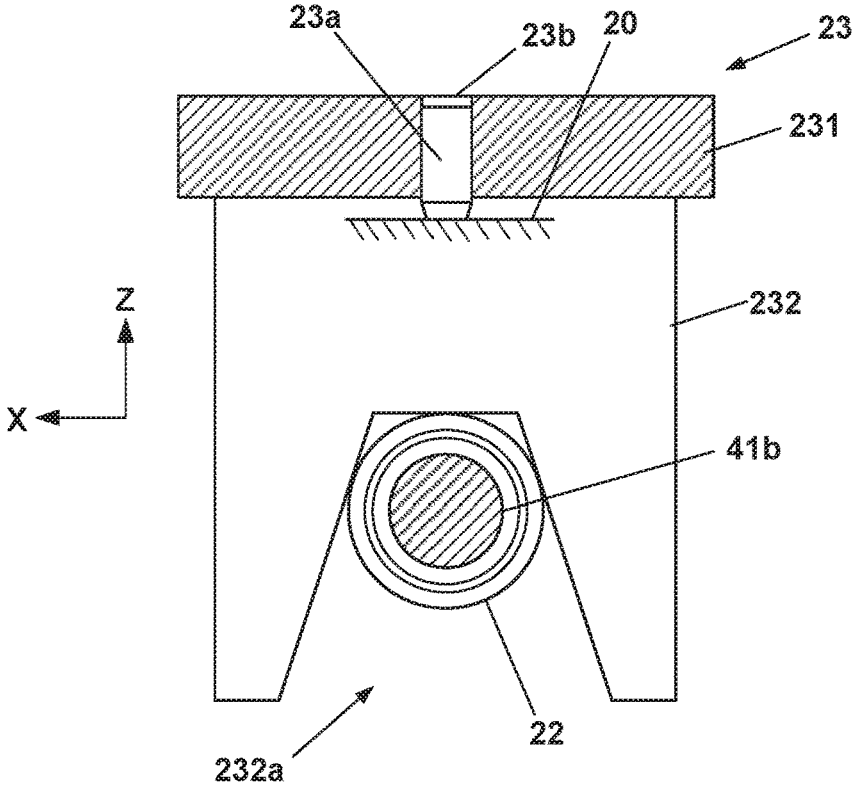

If the transfer drum 41 is displaced with respect to the printing unit 3 as a result of adjusting the center distance by the axial distance adjusting mechanism 21, the relative positional relationship between the printheads 30 and the transfer member 2 is changed. This may cause a shift in ink discharge position with respect to the transfer member 2. To prevent this, a structure that supports the printing unit 3 to be displaced together with the rotation-center axis 41*b* of the transfer drum 41 is adopted in this embodiment. In addition to FIGS. 8 to 10B, FIGS. 11A and 11B are referred to. FIG. 11A is a perspective view showing the vicinity of the end on the side of the gear 41*a* of the transfer drum 41. FIG. 11B is a view showing an example of the arrangement of a supporting unit 23.

In this embodiment, the supporting unit 23 supports the printing unit 3 at the discharge position POS1. The supporting unit 23 is supported on the rotation-center axis 41*b*. An arrangement in which the supporting unit 23 is mounted directly on the rotation-center axis can also be adopted. In this embodiment, however, the supporting unit 23 is mounted on a tube member 22 provided on the rotation-center axis 41*b* so as not to apply a rotation load to the rotation-center axis 41*b*. In this embodiment, the tube member 22 is a ball bearing, has a center hole where the rotation-center axis 41*b* is fitted in its inner ring, and includes the supporting unit 23 mounted on its outer ring. The tube member 22 may be a sleeve bearing, and its outer ring portion may be made of a square-shaped member. However, by using the tube member 22 of the ball bearing as in this embodiment, it is possible to support the printing unit 3 via the supporting unit 23 while maintaining the smooth rotation of the rotation-center axis 41*b*.

The supporting unit 23 integrally includes an upper portion 231 which is located above the center of the frame 20 and extends in the X direction, and a mounting portion 232 located on a side closer to the transfer drum 41 than the frame 20 in the Y direction. A trapezoid notch 232*a* is formed in the lower part of the mounting portion 232. The lower part of the mounting portion 232 forms a pair of bifurcated leg portions. The notch 232*a* contacts the outer ring of the tube member 22 at three points, and the mounting portion 232 is mounted on the tube member 22 in a straddle form. An attachment hole 23*b* where a contact member 23*a* is attached is formed at the center of the upper portion 231 in the Z direction. The contact member 23*a* is, for example, a screw such as a bolt. The attachment hole 23*b* is, for example, a screw hole.

The lower end of the contact member 23*a* contacts the frame 20. This prevents the supporting unit 23 from rotating about the rotation-center axis 41*b*. The contact member 23*a* is a rotation stop member of the supporting unit 23.

When the axial distance adjusting mechanism 21 adjusts the center distance, the contact member 23*a* is loosened and separated from the frame 20 as needed. When the axial distance adjusting mechanism 21 displaces the transfer drum 41, the supporting unit 23 is also displaced together with the rotation-center axis 41*b*. Consequently, the relative positional relationship between the printheads 30 and the transfer member 2 is maintained, eliminating the need for positional adjustment. It is therefore possible to reduce occurrence of the shift in ink discharge position with respect to the transfer member 2. When center distance adjustment ends, the lower end of the contact member 23*a* is brought into contact with the frame 20 to serve as the rotation stop member.

Next, in this embodiment, the printing unit 3 can be displaced between the discharge position POS1 and the recovery position POS3, and is detachable from the supporting unit 23. The supporting unit 23 is displaced together with the rotation-center axis 41*b*, and it is therefore necessary that the printing unit 3 is attached to the supporting unit 23 appropriately when attached to the supporting unit 23. In this embodiment, as shown in FIG. 11A, an arrangement in which the supporting unit 23 includes a positioning structure that includes positioning members 233 to 235, and the printing unit 3 is elevated and floatingly supported with respect to the slide portions 32A and 32B is adopted. An example of the structure will be described with reference to FIGS. 12 to 14.

Figure 12:
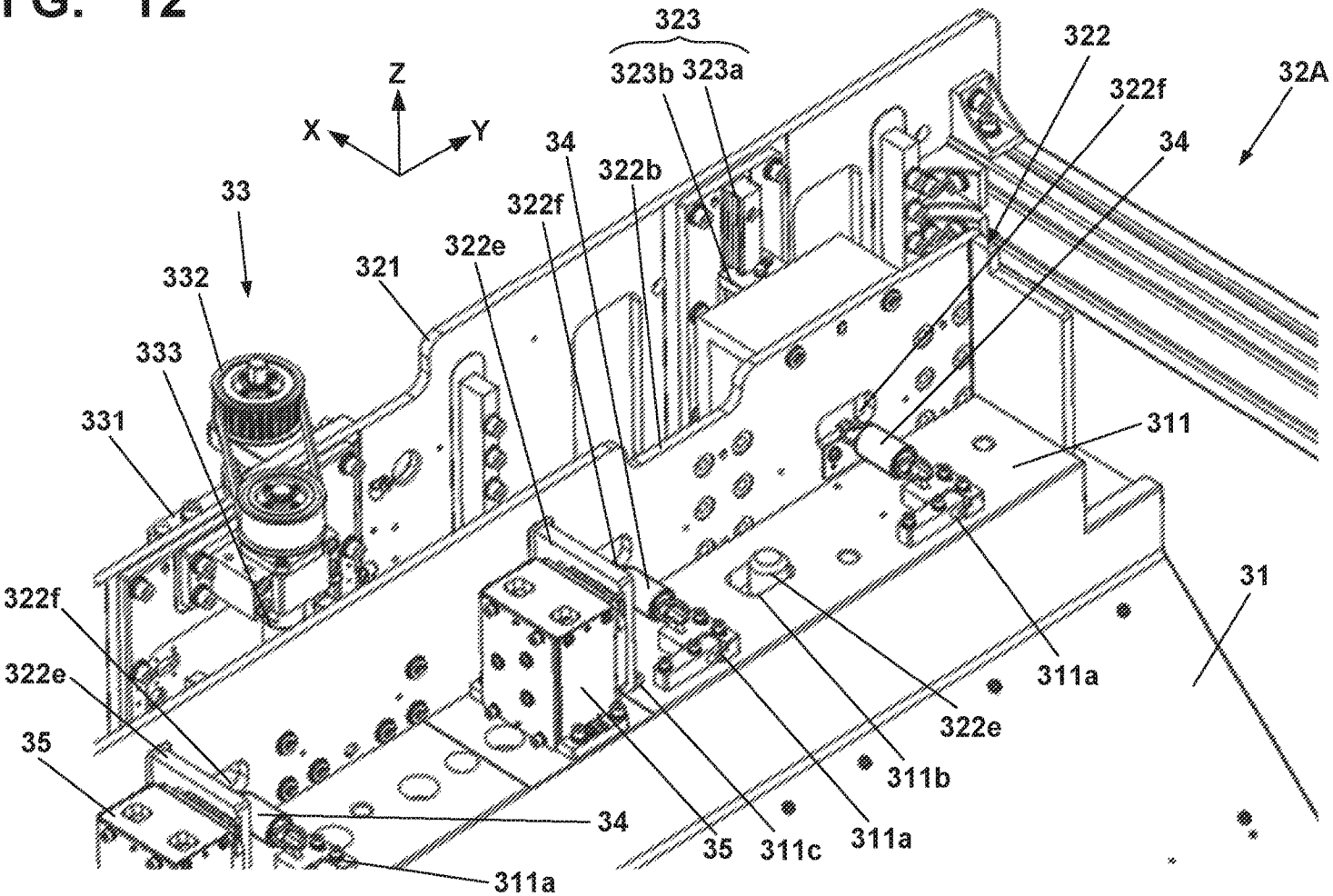
FIG. 12 is a view for explaining a mechanism that elevates the printing unit and a floating support structure.
Figure 13:
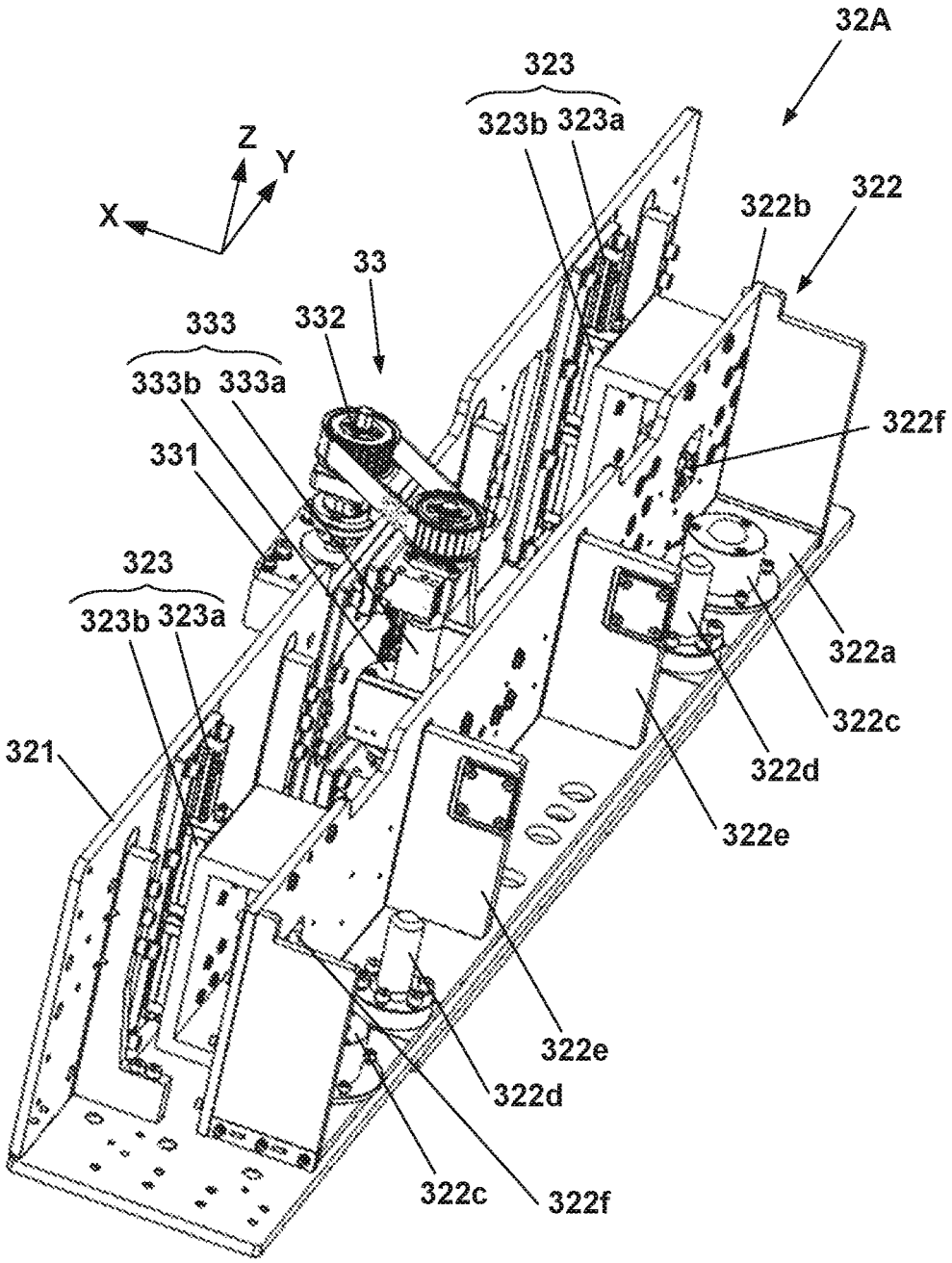
FIG. 13 is a view for explaining the mechanism that elevates the printing unit and the floating support structure.

FIG. 12 is a perspective view showing a part of the slide portion 32A. FIG. 13 is a perspective view obtained by removing the carriage 31 from the slide portion 32A. The arrangement of the slide portion 32A will be described here. However, the slide portion 32B has the same arrangement.

The slide portion 32A includes a main frame 321 and a sub frame 322. The main frame 321 is an L-shaped member and extends in the Y direction. The sub frame 322 is also an L-shaped member and extends in the Y direction. The sub frame 322 is arranged inside the main frame 321 and connected to the main frame 321 via a plurality of slide mechanisms 323. The slide mechanisms 323 include a rail member 323*a* that extends in the Z direction and a slider 323*b* that slides on the rail member 323*a*. The rail member 323*a* is fixed to the main frame 321, and the slider 323*b* is fixed to a vertical wall portion 322*b* of the sub frame 322 via a bracket. The sub frame 322 is relatively and freely displaced in the Z direction with respect to the main frame 321 by providing the slide mechanisms 323.

The carriage 31 is supported by the sub frame 322 at an end 311 in the X direction. An elevating unit 33 is provided between the main frame 321 and the sub frame 322. The elevating unit 33 elevates the sub frame 322 with respect to the main frame 321. In other words, the elevating unit 33 elevates the printing unit 3 with respect to the main frame 321. The elevating unit 33 is provided not only in the slide portion 32A but also in the slide portion 32B, and the printing unit 3 translates in the Z direction by driving them synchronously.

In this embodiment, the elevating unit 33 includes a driving source 331, and transmission mechanisms 332 and 333. In this embodiment, the driving source 331 is a motor and fixed to the main frame 321. In this embodiment, the transmission mechanism 333 is a ball screw mechanism, and includes a ball screw 333*a* and a ball nut 333*b* that engages with the ball screw 333*a*. The ball screw 333*a* is supported rotatably by the main frame 321, and its rotation axis direction is the Z direction. The ball nut 333*b* is supported by the sub frame 322. The ball nut 333*b* moves by rotating the ball screw 333*a*, elevating the sub frame 322.

In this embodiment, the transmission mechanism 332 is a belt transmission mechanism and transmits the driving force of the driving source 331 to the ball screw 333*a*. It is possible to control elevation of the sub frame 322, that is, the printing unit 3 by controlling driving of the driving source 331.

A floating support structure between the sub frame 322 and the carriage 31 will be described. In this embodiment, the carriage 31 has a support form in which the end 311 is just placed on a bottom wall 322*a* of the sub frame 322, and the carriage 31 can be displaced relatively with respect to the sub frame 322 in the respective X, Y, and Z directions.

A plurality of placing members 322*c* are provided on the bottom wall 322*a*, and the end 311 is placed on the plurality of placing members 322*c*. Spherical projections that support the end 311 from below are formed at the tops of the placing members 322*c*, reducing the displacement friction of the end 311 in the X direction and the Y direction.

A plurality of position regulating members 322*d* are also provided on the bottom wall 322*a*. The position regulating members 322*d* are axial members extending in the Z direction and pass through an opening 311*b* formed in the end 311. Relative displacement of the printing unit 3 is regulated by bringing the periphery of the opening 311*b* and the position regulating members 322*d* into contact with each other. The position regulating members 322*d* and the opening 311*b* are designed so as to have sizes corresponding to the relative displacement of the printing unit 3.

A biasing unit 34 and a biasing unit 35 are provided between the sub frame 322 and the carriage 31. The biasing unit 34 biases the carriage 31 in one X direction, and the biasing unit 35 biases the carriage 31 in one Y direction. These biasing directions are set in directions of bringing the carriage 31 into contact with the positioning members 234 and 235, details of which will be described later.

In this embodiment, the biasing unit 34 is an elastic member and is particularly a coil spring. One end of the biasing unit 34 is locked to a locking portion 322*f* provided on the vertical wall portion 322*b*, and the other end is locked to a locking portion 311*a* provided in the end 311.

Figure 14:
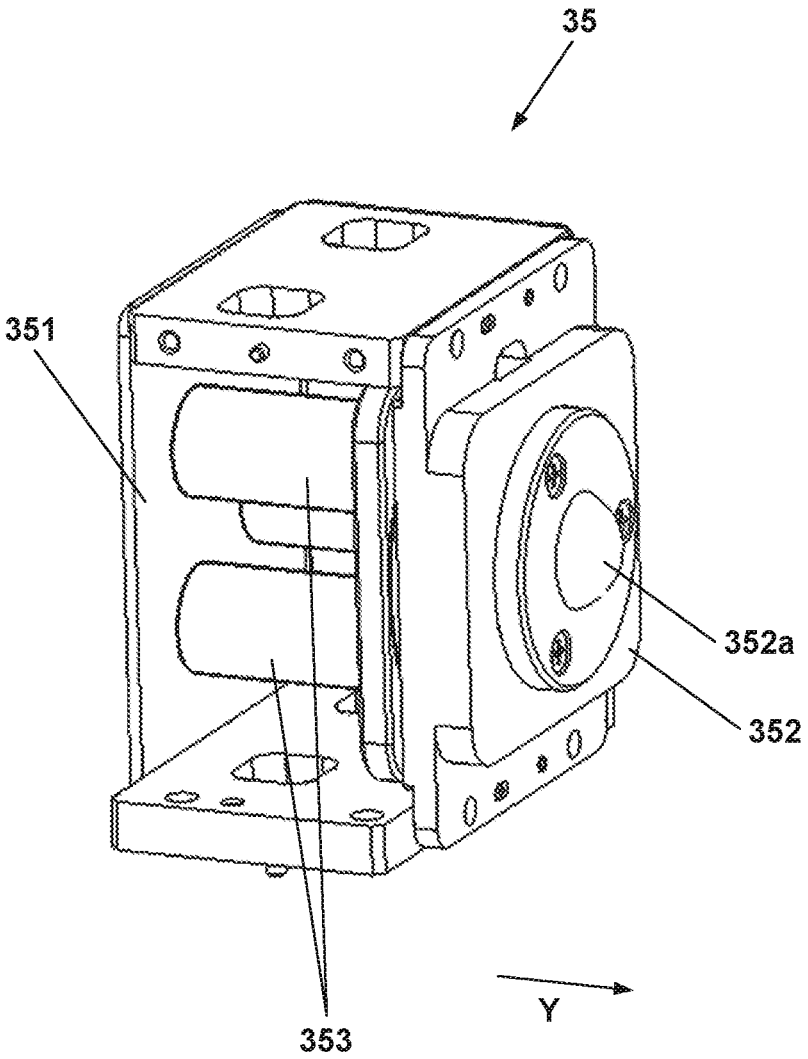
FIG. 14 is a perspective view showing a biasing unit.

FIG. 14 is a perspective view showing the biasing unit 35. The biasing unit 35 includes a case 351, a movable portion 352, and elastic members (here, coil springs) 353 loaded between them. The movable portion 352 is displaced freely in the Y direction with respect to the case 351 and partially includes a spherical pressing portion 352*a*.

Referring back to FIGS. 12 and 13, the biasing unit 34 is mounted on the end 311. The sub frame 322 includes a wall portion 322*e* that contacts the pressing portion 352*a*. The wall portion 322*e* passes through a groove 311*c* formed in the end 311 and projects on the end 311. The pressing portion 352*a* presses the wall portion 322*e* in the Y direction by the biasing force of each elastic member 353.

With the above arrangement, the printing unit 3 is floatingly supported by the slide portions 32A and 32B.

Figure 15:
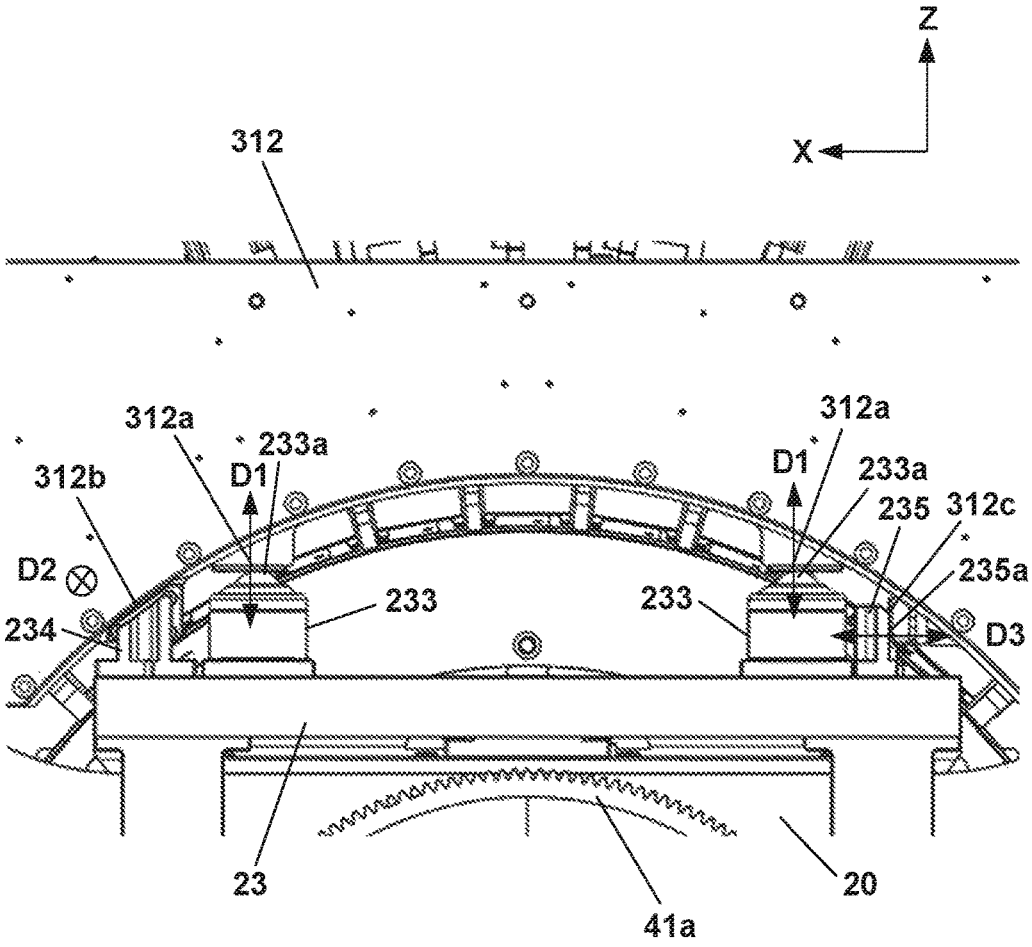
FIG. 15 is a view for explaining the positioning structure of the printing unit at a print position.

The positioning structure of the printing unit 3 at the discharge position POS1 will be described next with reference to FIGS. 15 to 20B. FIG. 15 shows a state in which the printing unit 3 is mounted on the supporting unit and positioned.

The supporting unit 23 includes the positioning members 233 to 235. In this embodiment, the two positioning members 233 are provided separately in the X direction. One positioning member 234 and one positioning member 235 are provided. Each positioning member 233 includes a spherical contact portion 312*a*. The positioning member 234 includes a planar contact portion 234*a* (located and hidden on the back side of the positioning member 234 in FIG. 15). Representing the plane of the contact portion 234*a* in the X, Y, and Z directions, the contact portion 234*a* has an X-Z plane. The positioning member 235 includes a planar contact portion 235*a*. Representing the plane of the contact portion 235*a* in the X, Y, and Z directions, the contact portion 235*a* has a Y-Z plane.

The contact portions 312*a*, and contact portions 312*b* and 312*c* are formed on a side wall 312 of the carriage 31. The contact portions 312*a* contact contact portions 233*a*. Each contact portion 312*a* is formed in a planar shape, and representing the plane of the contact portion 312*a* in the X, Y, and Z directions, the contact portion 233*a* has an X-Y plane. A contact direction D1 of the contact portions 233*a* and the contact portions 312*a* is a vertical direction, and positioning of the carriage 31 with respect to the supporting unit 23 in the vertical direction (Z direction) is performed by contact between these.

The contact portion 312*b* contacts the contact portion 234*a*. The contact portion 312*b* is formed in a planar shape, and representing the plane of the contact portion 312*b* in the X, Y, and Z directions, the contact portion 312*b* has an X-Y plane. A contact direction D2 of the contact portion 234*a* and the contact portion 312*b* is a depth direction, and positioning of the carriage 31 with respect to the supporting unit 23 in the depth direction (Y direction) is performed by contact between these.

The contact portion 312*c* contacts the contact portion 235*a*. The contact portion 312*c* is formed in a planar shape, and representing the plane of the contact portion 312*c* in the X, Y, and Z directions, the contact portion 312*c* has a Y-Z plane. A contact direction D3 of the contact portion 235*a* and the contact portion 312*c* is a right-and-left direction, and positioning of the carriage 31 with respect to the supporting unit 23 in the right-and-left direction (X direction) is performed by contact between these.

A positioning mode of the printing unit 3 with respect to the supporting unit 23 when the printing unit 3 is returned from the recovery position POS3 to the discharge position POS1 will be described with reference to FIGS. 16A to 20B.

Figure 16A:
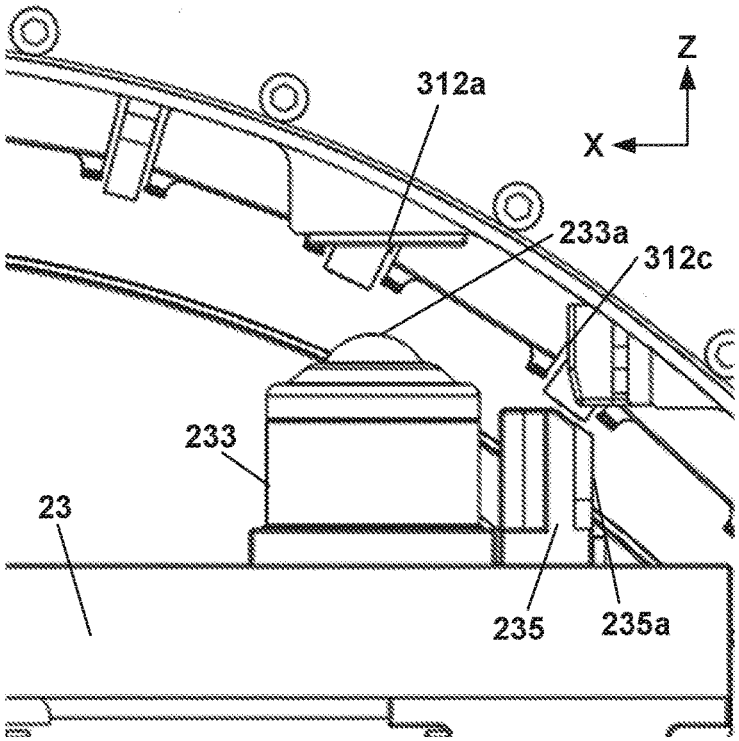
FIGS. 16A and 16B are views for explaining a positioning operation of the printing unit at the print position.
Figure 16B:
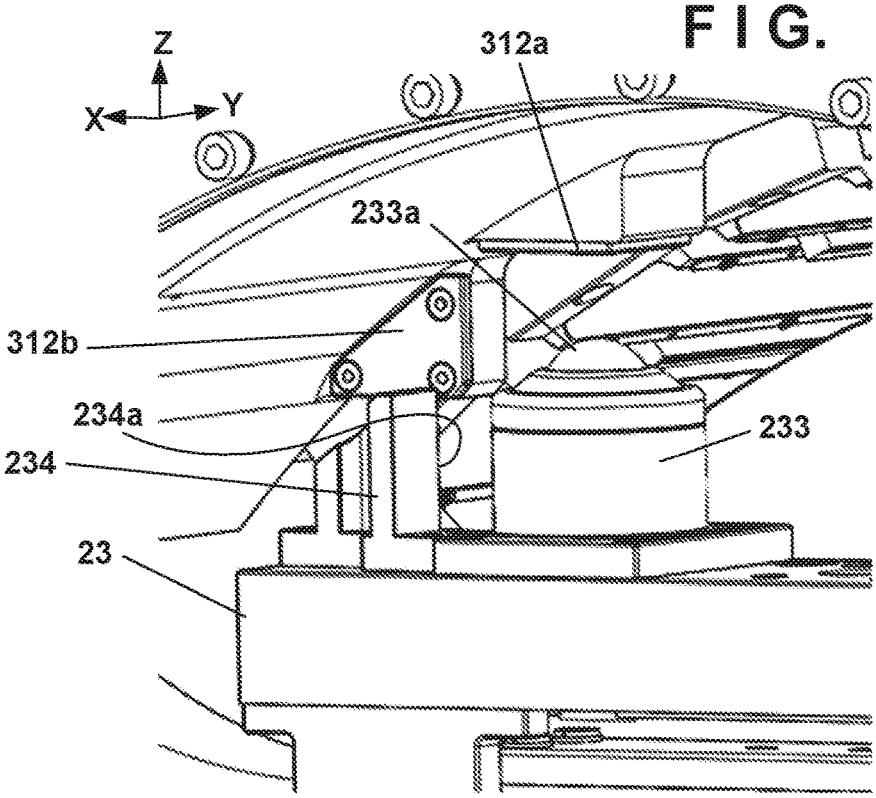

Each of FIGS. 16A and 16B shows a state before positioning. The printing unit 3 is located on a side closer to the recovery position POS3 than the discharge position POS1 and also located at an upper position. The contact portions 233*a* to 235*a*, and the contact portions 312*a* to 312*c* are spaced apart from each other.

Subsequently, when the printing unit 3 reaches a position on a side slightly closer to the recovery position POS3 than the discharge position POS1 by driving the driving mechanism DU with the guide unit RL1, the elevating unit 33 starts lowering the printing unit 3.

Figure 17A:
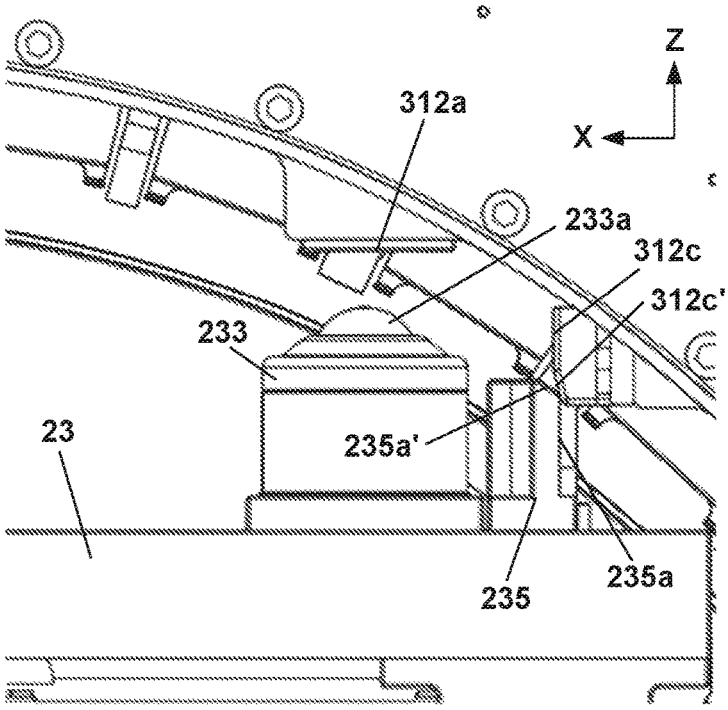
FIGS. 17A and 17B are views for explaining the positioning operation of the printing unit at the print position.
Figure 17B:
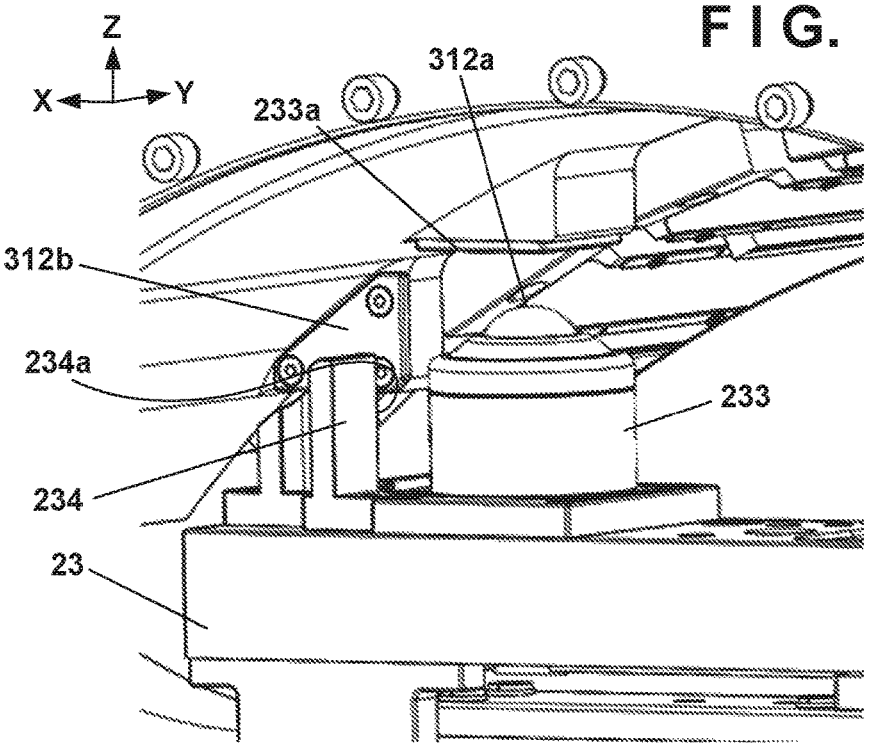

Each of FIGS. 17A and 17B shows a state in the middle of a lowering operation of the printing unit 3. The contact portions 233*a* and 234*a*, and the contact portions 312*a* and 312*b* are spaced apart from each other. An inclined surface 312*c*' is formed below the contact portion 312*c*, and an inclined surface 235*a*' is formed above the contact portion 235*a*. The biasing unit 34 biases the printing unit 3 on the left side of FIG. 17A in the X direction, and these inclined surfaces start to contact each other in the middle of the lowering operation of the printing unit 3.

Figure 18A:
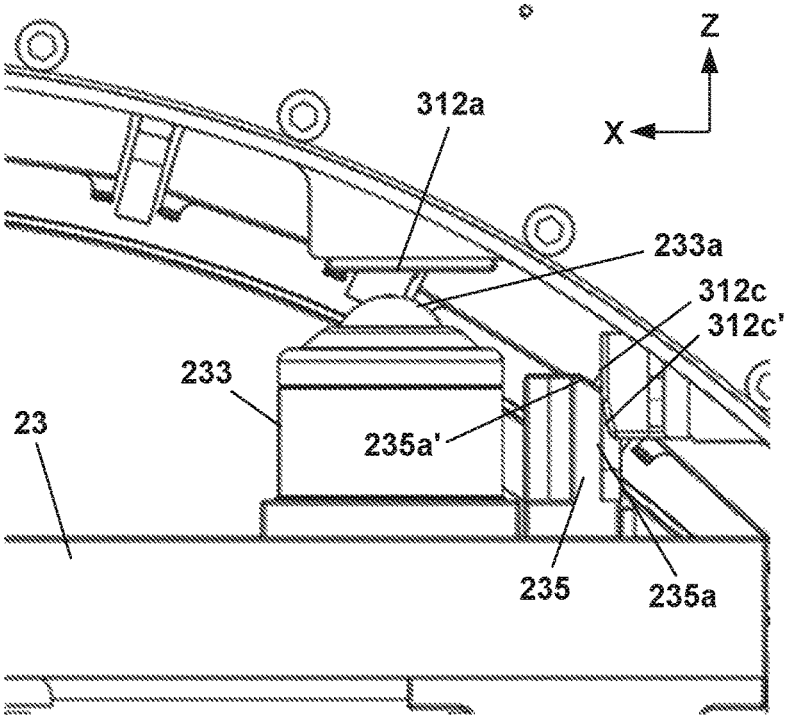
FIGS. 18A and 18B are views for explaining the positioning operation of the printing unit at the print position.
Figure 18B:
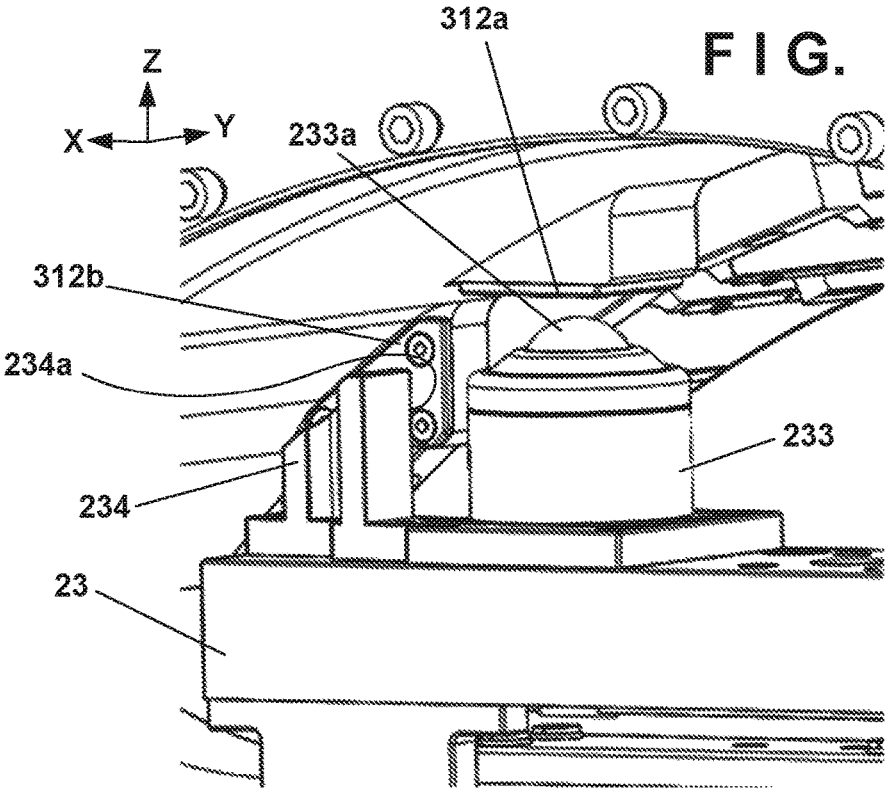

Each of FIGS. 18A and 18B shows a state in the middle of the lowering operation in which the printing unit 3 is further lowered. The contact portions 233*a* and 234*a*, and the contact portions 312*a* and 312*b* are spaced apart from each other. By the guides of the respective inclined surfaces 235*a*' and 312*c*', the printing unit 3 is displaced on the right side of FIG. 18A in the X direction against the biasing force of the biasing unit 34, bringing the contact portion 235*a* and the contact portion 312*c* into contact with each other in the X direction. Thus, the printing unit 3 is positioned in the X direction first.

Figure 19A:
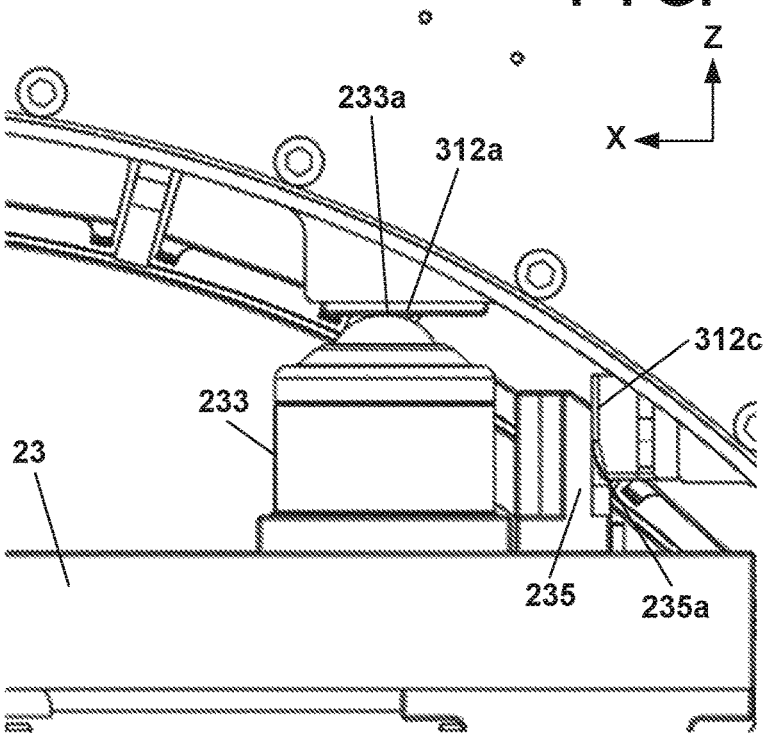
FIGS. 19A and 19B are views for explaining the positioning operation of the printing unit at the print position.
Figure 19B:
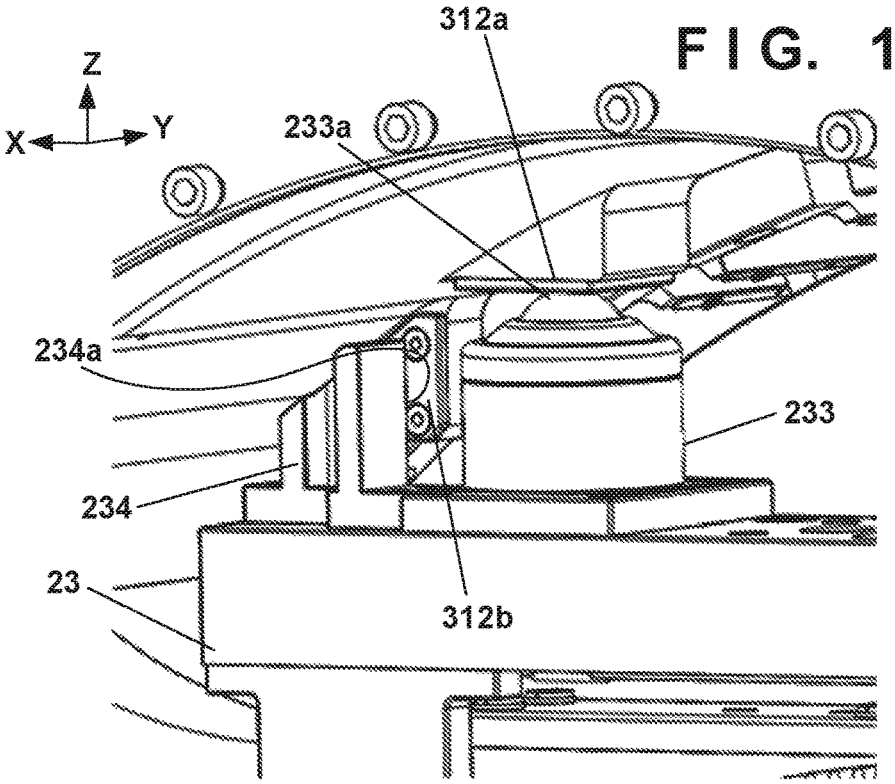

Each of FIGS. 19A and 19B shows a state in which the printing unit 3 is still further lowered. The contact portion 234*a* and the contact portion 312*b* are spaced apart from each other. The contact portions 233*a* and the contact portions 312*a* contact each other in the Z direction, positioning the printing unit 3 in the Z direction. The printing unit 3 is transferred from the placing members 322*c* of the sub frame 322 onto the positioning member 233.

Figure 20A:
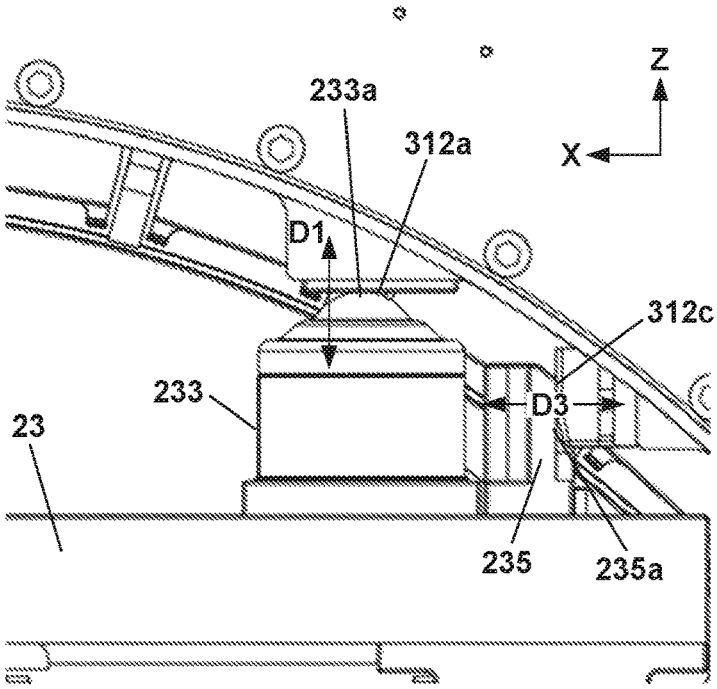
FIGS. 20A and 20B are views for explaining the positioning operation of the printing unit at the print position.
Figure 20B:
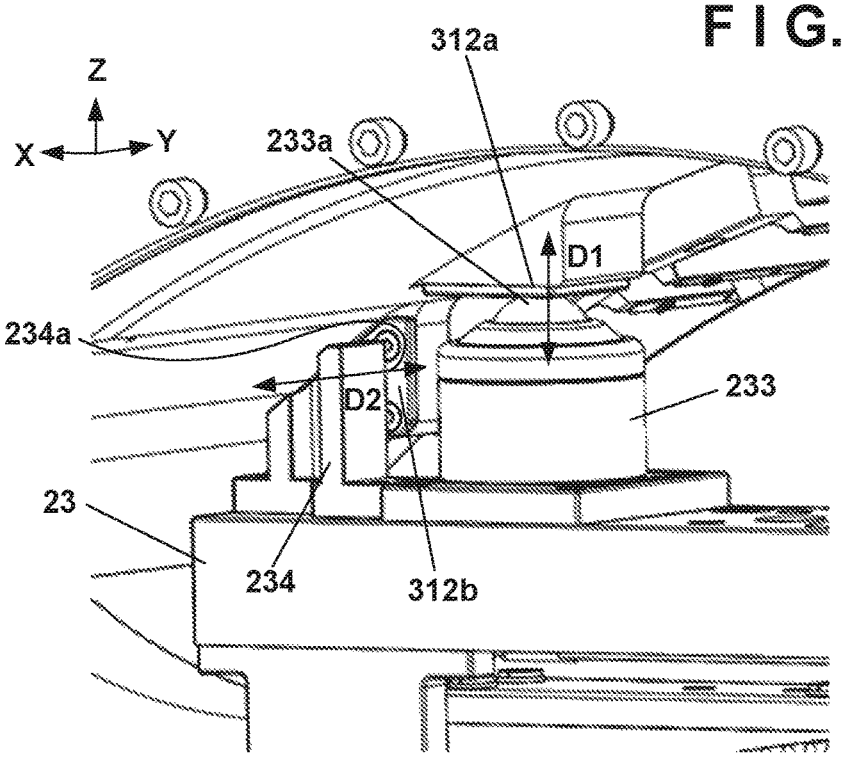

Each of FIGS. 20A and 20B shows a state in which the printing unit 3 reaches the discharge position POS1 and stops, and its lowering operation is also complete. The biasing unit 35 biases the printing unit 3 on the near side of each of FIGS. 20A and 20B in the Y direction, and the contact portion 234*a* and the contact portion 312*b* contact each other in the Y direction in a process in which the printing unit 3 reaches the discharge position POS1, positioning the printing unit 3 in the Y direction. Thus, in this embodiment, the printing unit 3 is positioned with respect to the supporting unit 23 for each direction in the order of the X direction, the Z direction, and the Y direction, making it possible to perform positioning in the three directions more reliably. When the printing unit 3 is moved to the recovery position POS3, it can be moved in the Y direction by driving the driving mechanism DU with the guide unit RL1 while raising the printing unit 3 by driving the elevating unit 33. Consequently, the printing unit 3 is separated from the supporting unit 23 and moved to the recovery unit 12.

With the above positioning structure, it is possible to position the printing unit 3 with respect to the supporting unit 23 appropriately even if the supporting unit 23 is displaced as the result of adjusting the center distance by the axial distance adjusting mechanism 21. Note that even in an arrangement neither having the axial distance adjusting mechanism 21 nor displacement of the supporting unit 23, the above-described positioning structure is advantageous in terms of positioning of the printing unit 3 with respect to the supporting unit 23 in an arrangement in which the position of the printing unit 3 is displaced as in this embodiment. With such a positioning structure, it is possible to improve a position accuracy when the printheads 30 return from the recovery position POS3 to the discharge position POS1.

Another Embodiment

In the above embodiment, the printing unit 3 includes the plurality of printheads 30. However, a printing unit 3 may include one printhead 30. The printhead 30 may not be a full-line head but may be of a serial type that forms an ink image by discharging ink from the printhead 30 while a carriage that mounts the printhead 30 detachably moves in a Y direction.

A conveyance mechanism of a print medium P may adopt another method such as a method of clipping and conveying the print medium P by a pair of rollers. In the method of conveying the print medium P by the pair of rollers or the like, a roll sheet may be used as the print medium P, and a printed product P' may be formed by cutting the roll sheet after transfer.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2017-078481, filed, Apr. 11, 2017, which is hereby incorporated by reference herein in its entirety.

What is claimed is:

1. A printing apparatus comprising:

a transfer drum;

a printing unit configured to form an ink image on the transfer drum by discharging ink;

a pressurizing drum configured to transfer the ink image formed on the transfer drum to a print medium which passes between the pressurizing drum and the transfer drum;

a guide unit configured to guide the printing unit to a discharge position for the printing unit to discharge the ink to the transfer drum and a retreat position where the printing unit retreats from the discharge position;

an adjusting member supporting a rotation-center axis of the transfer drum and configured to adjust a position of the transfer drum with regard to the pressurizing drum, and a positioning unit configured to position the printing unit at the discharge position and be displaced together with the transfer drum displaced by the adjusting member.

2. The apparatus according to claim 1, further comprising a supporting unit configured to support the printing unit at the discharge position, wherein the positioning unit is provided on the supporting unit.

3. The apparatus according to claim 2, further comprising an elevating unit configured to elevate the printing unit with respect to the supporting unit, wherein when the printing unit is moved downward onto the supporting unit, the printing unit is positioned by the positioning structure.

4. The apparatus according to claim 3, wherein the printing unit is floatingly supported with respect to the elevating unit.

5. The apparatus according to claim 3, wherein the printing unit includes a printhead configured to discharge ink, and a carriage configured to support the printhead, the positioning unit includes a plurality of first contact portions provided for the supporting unit, a plurality of second contact portions are provided for the carriage and configured to contact the plurality of first contact portions, and combinations of the plurality of first contact portions and the plurality of second contact portions includes a plurality of combinations mutually different in contact direction.

6. The apparatus according to claim 5, wherein a contact direction of one of the plurality of combinations is a vertical direction, a contact direction of another of the plurality of combinations is a conveyance direction of a print medium between the pressurizing drum and the transfer drum, and a contact direction of still another of the plurality of combinations is a direction of the rotation-center axis of the transfer drum.

7. The apparatus according to claim 1, further comprising a recovery unit configured to recover performance of the printing unit, wherein the recovery unit is arranged adjacent to the transfer drum in a direction of the rotation-center axis of the transfer drum, the retreat position is a recovery position for the recovery unit to recover the performance of the printing unit, and the guide unit guides movement of the printing unit in the direction of the rotation-center axis.

* * * * *